US011468807B2

(12) United States Patent
Park

(10) Patent No.: US 11,468,807 B2
(45) Date of Patent: Oct. 11, 2022

(54) RGB SIMULTANEOUS CORRECTION-TYPE DEVICE FOR DISPLAY GAMMA CORRECTION

(71) Applicant: SP Technology Co., Ltd., Anyang-si (KR)

(72) Inventor: Yong Jin Park, Uiwang-si (KR)

(73) Assignee: SP TECHNOLOGY CO., LTD.

( * ) Notice: Subject to any disclaimer, the term of this patent is extended or adjusted under 35 U.S.C. 154(b) by 0 days.

(21) Appl. No.: 17/060,350

(22) Filed: Oct. 1, 2020

(65) Prior Publication Data

US 2021/0150952 A1 May 20, 2021

(30) Foreign Application Priority Data

Nov. 19, 2019 (KR) ..... 10-2019-0148426

(51) Int. Cl.
*G09G 3/00* (2006.01)
*G09G 3/20* (2006.01)

(52) U.S. Cl.
CPC ..... *G09G 3/006* (2013.01); *G09G 3/2003* (2013.01); *G09G 2320/0673* (2013.01)

(58) Field of Classification Search
CPC ..... G09G 3/006; G09G 3/2003; G09G 2320/0673
See application file for complete search history.

(56) References Cited

U.S. PATENT DOCUMENTS 10,170,077 B2 * 1/2019 Okamoto ..... G09G 5/02
2020/0143760 A1 * 5/2020 Kang ..... G09G 3/3607

FOREIGN PATENT DOCUMENTS

JP 2004-070119 A 3/2004
JP 2016-197249 A 11/2016
KR 10-0400610 B1 10/2003
KR 10-2004-0105085 A 12/2004
KR 10-0676817 B1 1/2007
KR 10-0918922 B1 9/2009

OTHER PUBLICATIONS

Korean Office Action (KR 10-2019-0148426), KIPO, dated Jan. 20, 2020.
Korean Decision to Grant (KR 10-2019-0148426), KIPO, dated Aug. 10, 2020.

* cited by examiner

*Primary Examiner* — Kenneth B Lee, Jr.
(74) *Attorney, Agent, or Firm* — Park & Associates IP Law, P.C.

(57) ABSTRACT

A RGB simultaneous correction-type device for display gamma correction is proposed, the device including an RGB test pattern output unit forming three division surfaces resulting from dividing a display into three surfaces around a center portion thereof and simultaneously outputting R, G, and B patterns to each of the division surfaces; a unit probe module having three probes disposed one by one at each of the division surfaces corresponding to the R, G, and B patterns; and a correction control unit analyzing each probe detection signal of the unit probe module to simultaneously perform gamma correction for R, G, and B values of each of the division surfaces, whereby there is an advantage of being capable of reducing the display gamma correction time by solving the problem that the time to sequentially output RGB colors during RGB correction is required in the test time.

2 Claims, 4 Drawing Sheets

RGB SIMULTANEOUS CORRECTION-TYPE DEVICE FOR DISPLAY GAMMA CORRECTION

REFERENCE TO RELATED APPLICATIONS

This application claims the priority benefit of Korean Patent Application No. 10-2019-0148426 filed on Nov. 19, 2019, the entire contents of which are incorporated herein by reference.

FIELD OF THE INVENTION

The present invention relates to a device for display gamma correction and, more particularly, to a RGB simultaneous correction-type device for display gamma correction, the device being capable of reducing an optimum gamma correction time for a display RGB test pattern output.

BACKGROUND OF THE INVENTION

In general, brightness, contrast, and gamma curves in a display become important factors that determine the image quality of the display. Therefore, in order to achieve vivid image quality and good color reproduction, the brightness, contrast, and gamma curves in the display should be adjusted to an optimal state.

Such adjustment process is called a gamma correction, and the basic concepts and methods thereof are disclosed in Korean Patent No. 10-0918922 titled "Hybrid gamma correction method", Korean Patent No. 10-0676817 titled "Gamma adjustment method and gamma adjustment system of display device", Korean Patent No. 10-0400610 titled "Method of automatically correcting display color and program recording medium", and so on.

To display the optimal screen state or standardized screen state on the display in the related art, gamma values of RGB colors (i.e., Red, Green and blue) are selected using the display color correction pattern and then are converted into sRGB (Standard RGB), which is a standard display color standard, thereby making an ICC profile.

In order to select the gamma values of the RGB colors in the related art, a probe is installed in the center portion of the display, the color change is performed according to the RGB sequence, and then the gamma value is selected according to each RGB value.

As described above, since the time to sequentially output the RGB colors when correcting the RGB colors in the related art is required, there is a problem of increasing the test time.

(Patent Document 1) Korean Patent No. 10-0918922 "Hybrid gamma correction method"

(Patent Document 2) Korean Patent No. 10-0676817 "Gamma adjustment method and gamma adjustment system of display device"

(Patent Document 3) Korean Patent No. 10-0400610 "Method of automatically correcting display color and program recording medium"

SUMMARY OF THE INVENTION

Accordingly, the present invention has been made keeping in mind the above problems occurring in the related art, and an objective of the present invention is to provide a RGB simultaneous correction-type device for display gamma correction, the device being capable of reducing the display gamma correction time by solving the problem that the time to sequentially output RGB colors during RGB correction is required in the test time.

In order to achieve the above objective, the present invention provides a device for display gamma correction, the device including an RGB test pattern output unit forming three division surfaces resulting from dividing a display into three surfaces around a center portion thereof and simultaneously outputting R, G, and B patterns to each of the division surfaces; a unit probe module having three probes disposed one by one at each of the division surfaces corresponding to the R, G, and B patterns; and a correction control unit analyzing each probe detection signal of the unit probe module to simultaneously perform gamma correction for R, G, and B values of each of the division surfaces, in which the RGB correction is performed simultaneously for the center point of the display.

Herein, the RGB test pattern output unit may divide the display into multiple division surfaces and form three sub-division surfaces resulting from dividing each of the multiple division surfaces into three surfaces around a center portion thereof, to output the R, G, B test patterns to each of the three sub-division surfaces simultaneously; and the unit probe module may be formed at the center portion of each of the multiple division surfaces, so that the RGB correction is performed simultaneously for multiple points of the display.

According to the present invention, there is an advantage of providing a RGB simultaneous correction-type device for display gamma correction, the device being capable of reducing the display gamma correction time by solving the problem that the time to sequentially output RGB colors during RGB correction is required in the test time.

BRIEF DESCRIPTION OF THE DRAWINGS

The above and other objects, features, and other advantages of the present invention will be more clearly understood from the following detailed description when taken in conjunction with the accompanying drawings, in which.

DETAILED DESCRIPTION OF THE INVENTION

The present invention will be described below with reference to the drawings. In describing the present invention, if it is determined that a detailed description of a related known technology or configuration may unnecessarily obscure the subject matter of the present invention, a detailed description thereof will be omitted.

Since the terms to be described later are terms defined in consideration of functions in the present invention, which may vary according to the intention or custom of users or operators, the definition should be made based on the contents throughout the specification describing the present invention.

Figure 1:
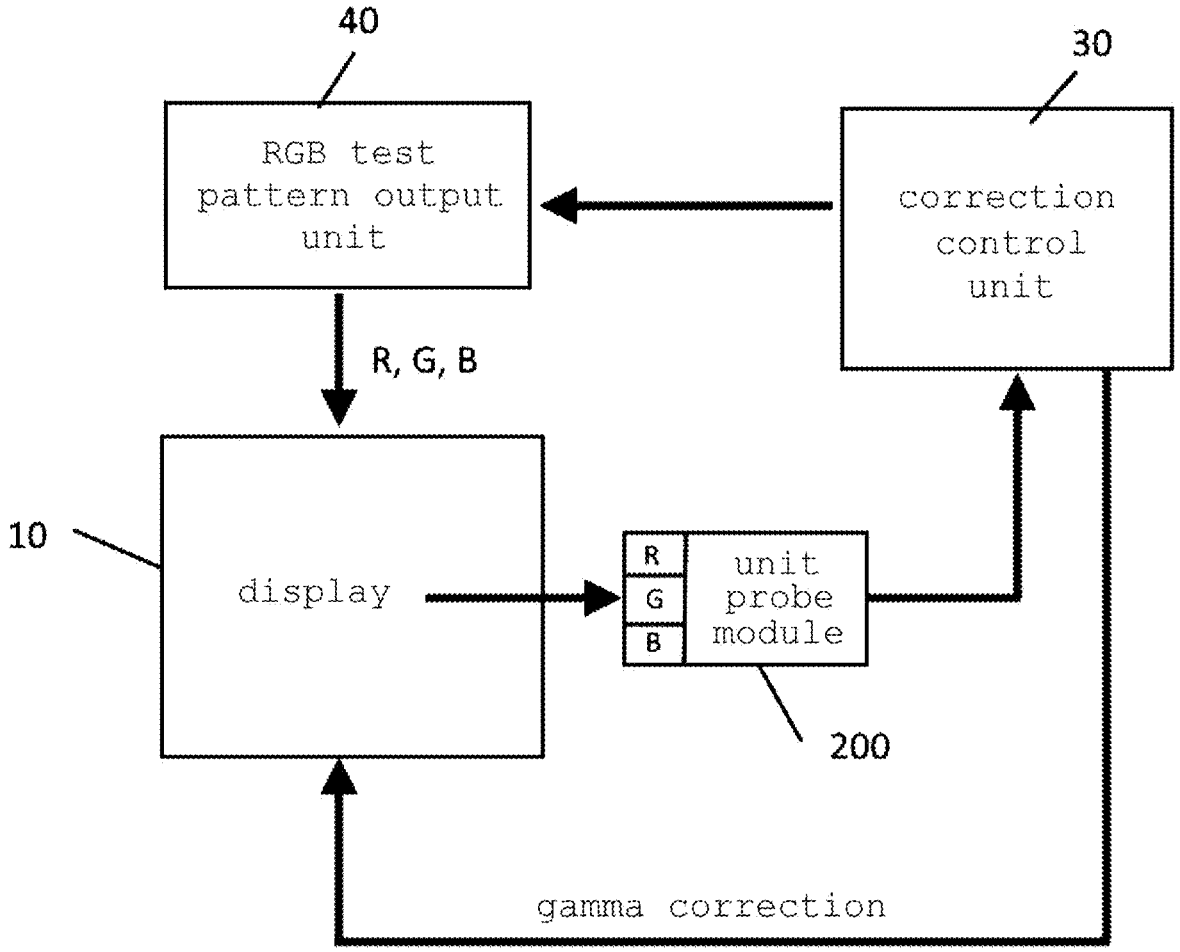
FIG. 1 is an overall block diagram illustrating the present invention.
Figure 2:
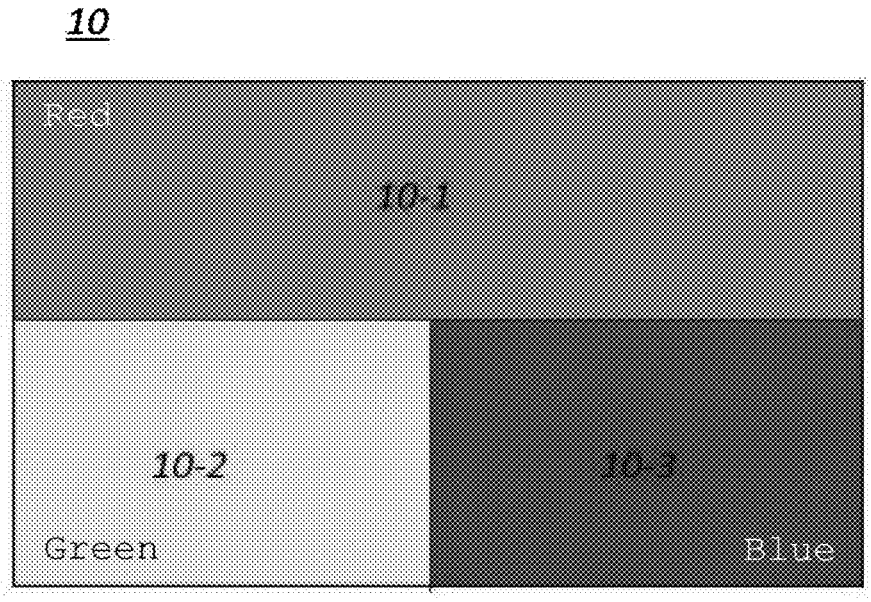
FIG. 2 is an exemplary diagram illustrating a display division according to the present invention.
Figure 3:
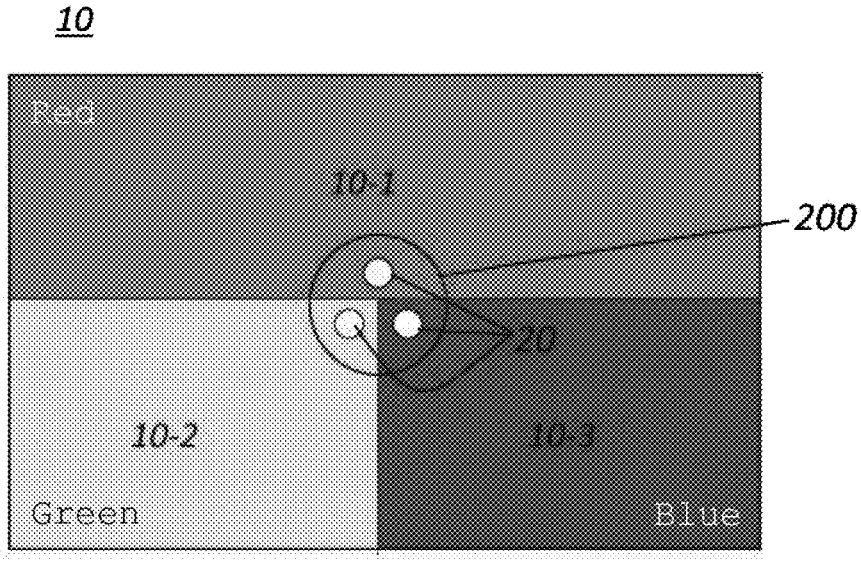
FIG. 3 is an exemplary diagram illustrating a probe arrangement in the case of the display division according to the present invention.
Figure 4:
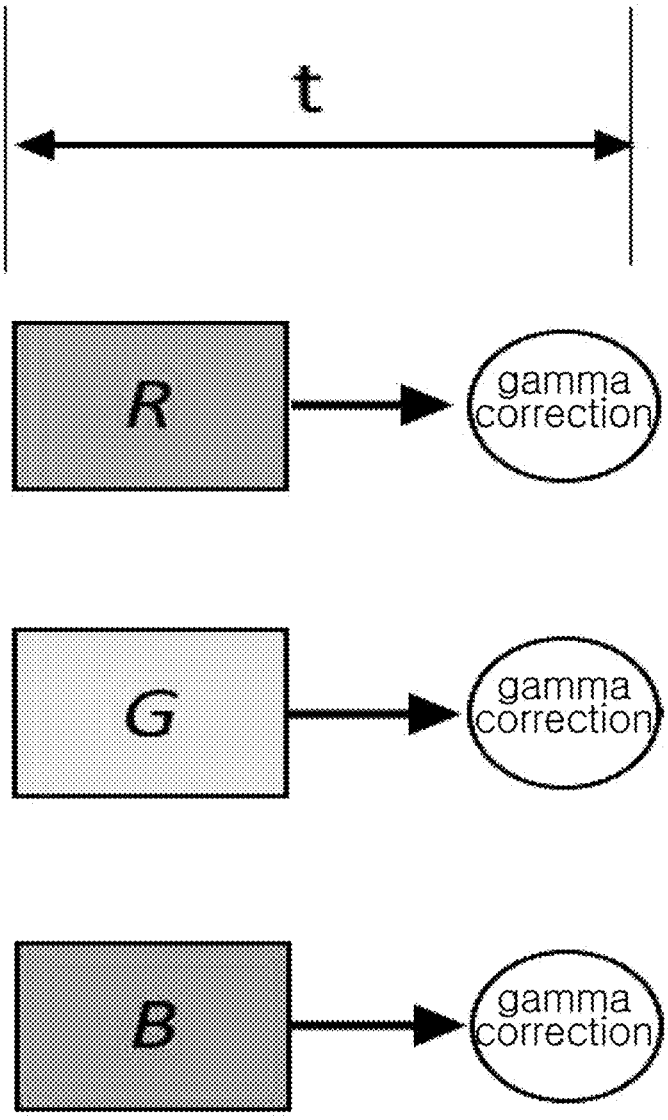
FIG. 4 is a block diagram illustrating a gamma correction time according to the present invention.
Figure 5:
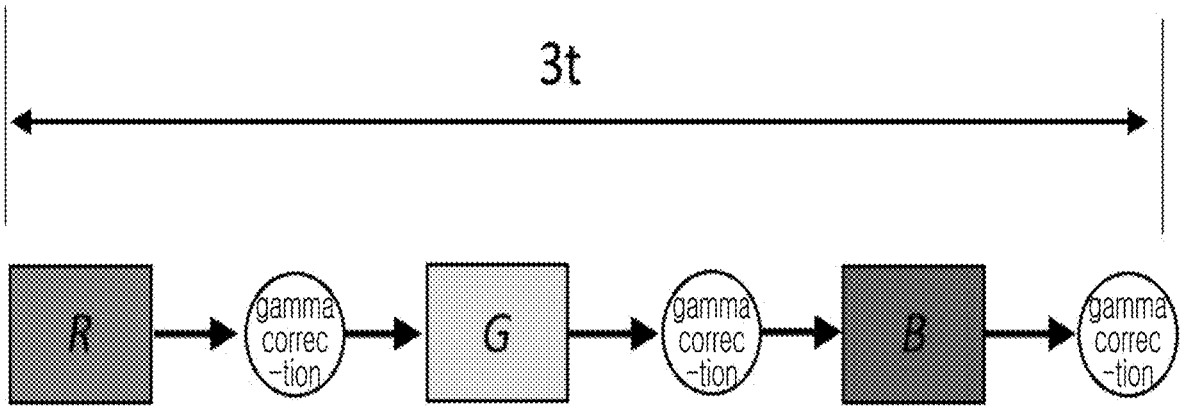
FIG. 5 is a block diagram illustrating a gamma correction time in the related art.

FIG. 1 is an overall block diagram illustrating the present invention; FIG. 2 is an exemplary diagram illustrating a display division according to the present invention; FIG. 3 is an exemplary diagram illustrating a probe arrangement in the case of the display division according to the present invention; FIG. 4 is a block diagram illustrating a gamma correction time according to the present invention; and FIG. 5 is a block diagram illustrating a gamma correction time in the related art.

As shown in the drawing, the present invention relates to a RGB simultaneous correction-type device for display gamma correction, in which the device is configured to include a probe 20, a correction control unit 30, and an RGB test pattern output unit 40.

The display gamma correction device according to the present invention is provided to output an RGB pattern to the display 10 and correct an optimal gamma value for an RGB color using the RGB pattern, in order to display an optimal screen state or a standardized screen state on the display 10.

The RGB test pattern output unit 40 according to the present invention is configured so that R, G, and B patterns are simultaneously output on three division surfaces obtained by dividing the correction target display into three surfaces around the center portion, as shown in FIG. 2.

Herein, each RGB test pattern output from the RGB test pattern output unit is the same as the known pattern. However, according to the present invention, the correction target display 10 is divided into three division surfaces around the center portion thereof and the RGB patterns are output to the division surfaces at the same time.

Therefore, such a characteristic of the present invention has a significant difference from the related art in that the RGB test patterns are sequentially output in the related art.

In addition, the display output surface may be divided into three equal division surfaces according to the present invention. Herein, when probes to be described later are disposed on each of the division surfaces, a desired effect of the present invention may be obtained.

However, since the display RGB gamma correction generally corrects the center portion of the display in order to perform gamma correction using an edge light source such as LCD, it is preferable that the display correction target surface is as close to the center as possible in order to use the present invention universally.

Therefore, it is preferable that the RGB test pattern output unit according to the present invention output RGB test patterns to each of division surfaces 10-1, 10-2, and 10-3 resulting from dividing the display 10 into three surfaces so that three colors are displayed in the center portion thereof.

The probes 20 according to the present invention are disposed on each of the three division surfaces of the display 10 to detect RGB pattern signals.

Specifically, according to the present invention, the RGB patterns are simultaneously output to the display 10, and the probes are disposed on each division surface, thereby simultaneously detecting the output RGB patterns.

As described above, when the RGB test pattern output unit 40 divides the display 10 into three surfaces with respect to the center portion of the display 10, the probes 20 may be formed as a unit probe module 200 including three probes 20 disposed in a triangle manner at the center portion of the display 10, as shown in FIG. 3.

The correction control unit 30 according to the present invention analyzes detection signals of the probes 20 to perform gamma correction for the R, G, and B values for each division surface.

Specifically, the correction control unit 30 receives and computes RGB test pattern signals from the probes 20 disposed on the division surfaces of each display 10, which is the unit probe module 200, and outputs the correction gamma value, thereby performing gamma correction.

The present invention is the same as the display correction device in the related art in that the RGB test patterns are output and detected to perform gamma correction. However, the R, G, and B test patterns are output and detected simultaneously according to the present invention as shown in FIG. 4, meanwhile the gamma correction is performed by sequentially outputting R, G, and B test patterns in the related art as shown in FIG. 5. Accordingly, the present invention has an advantage that the gamma correction time for the RGB test pattern can be reduced to ⅓.

As each pixel in LEDs has been developed that emits light independently through development stages of technology such as CRT and LCD in the related art, the characteristics of the present invention can be implemented because the test that determines a level of the overall display, not the center portion of the display may be performed.

Meanwhile, in order to perform gamma correction for a large area display, the present invention may be further provided so that the RGB test pattern output unit divides the display into multiple division surfaces and then divides each of the multiple division surfaces into three sub-division surfaces to simultaneously output the RGB test patterns to the sub-division surfaces, and the probes are formed as a plurality of unit probe modules each having each division surface as a unit.

As shown in the drawings, the drawings shown for the description of the present invention are one embodiment in which the present invention is embodied, and as shown in the drawings, it can be seen that combinations of various forms are possible in order to realize the subject matter of the present invention.

Therefore, the present invention is not limited to the above-described embodiments, and anyone of ordinary skill in the field to which the present invention pertains will have the technical spirit of the present invention to the extent that various modifications can be implemented without departing from the gist of the present invention as claimed in the following claims.

What is claimed is:

1. A device for display gamma correction, the device comprising:

an RGB test pattern output unit forming three division surfaces resulting from dividing a display into three non-overlapping surfaces around a center portion thereof and simultaneously outputting R, G, and B patterns to each of the division surfaces;

a unit probe module having three probes disposed one by one at each of the division surfaces corresponding to the R, G, and B patterns; and a correction control unit analyzing each probe detection signal of the unit probe module to simultaneously perform gamma correction for R, G, and B values of each of the division surfaces, in which the RGB correction is performed simultaneously for the center point of the display.

2. The device of claim 1, wherein the RGB test pattern output unit divides the display into multiple division surfaces and forms three sub-division surfaces resulting from dividing each of the multiple division surfaces into three non-overlapping surfaces around a center portion thereof, to output the R, G, B test patterns to each of the three sub-division surfaces simultaneously; and the unit probe module is formed at the center portion of each of the multiple division surfaces, so that the RGB correction is performed simultaneously for multiple points of the display.

* * * * *